United States Patent [19]

Wheeler

[11] Patent Number: 4,901,837

[45] Date of Patent: Feb. 20, 1990

[54] CLUTCH DRIVEN COMPRESSOR ASSEMBLY

[75] Inventor: Paul N. M. Wheeler, Pirton Nr. Hitchin, England

[73] Assignee: Allied-Signal Inc., Morristown, N.J.

[21] Appl. No.: 174,488

[22] Filed: Mar. 29, 1988

[30] Foreign Application Priority Data

Mar. 26, 1987 [GB] United Kingdom ..... 8707271
May 30, 1987 [GB] United Kingdom ..... 8712748

[51] Int. Cl.[4] ..... F16D 25/08; F04B 49/00

[52] U.S. Cl. ..... 192/85 CA; 192/91 A; 417/223; 417/319

[58] Field of Search ..... 192/85 AA, 85 CA, 91 A; 417/223, 319

[56] References Cited

U.S. PATENT DOCUMENTS 4,561,827 12/1985 Beaumont ..... 192/91 A
4,632,639 12/1986 Beaumont ..... 192/91 A
4,648,805 3/1987 Beaumont ..... 192/91 A

FOREIGN PATENT DOCUMENTS 2125114 2/1984 United Kingdom ..... 417/223
2176255 12/1986 United Kingdom ..... 192/85 AA
2182732 5/1987 United Kingdom ..... 192/85 CA
2188108 9/1987 United Kingdom ..... 192/91 A

*Primary Examiner*—Leslie A. Braun
*Assistant Examiner*—David A. Testardi
*Attorney, Agent, or Firm*—Ken C. Decker; William N. Antonis

[57] ABSTRACT

In a pneumatically operable clutch driven piston and cylinder compressor assembly a multiplate friction clutch comprises a drive member of the clutch carried on an input shaft which has internal bearings supporting the driven end of the compressor crankshaft and the drive shaft being rotatable in an island portion of the crankcase which carries a fluid pressure operable annular piston engageable with a shell of the clutch for release thereof, the arrangement permitting the clutch to be located at least in part within a projection of the cylinder of the compressor. A plurality of webs connecting the island portion with the crankcase are arranged to allow unrestricted communication between the compressor crankcase and a crankcase of an engine to which the compressor is mounted.

6 Claims, 3 Drawing Sheets

Figure 1:
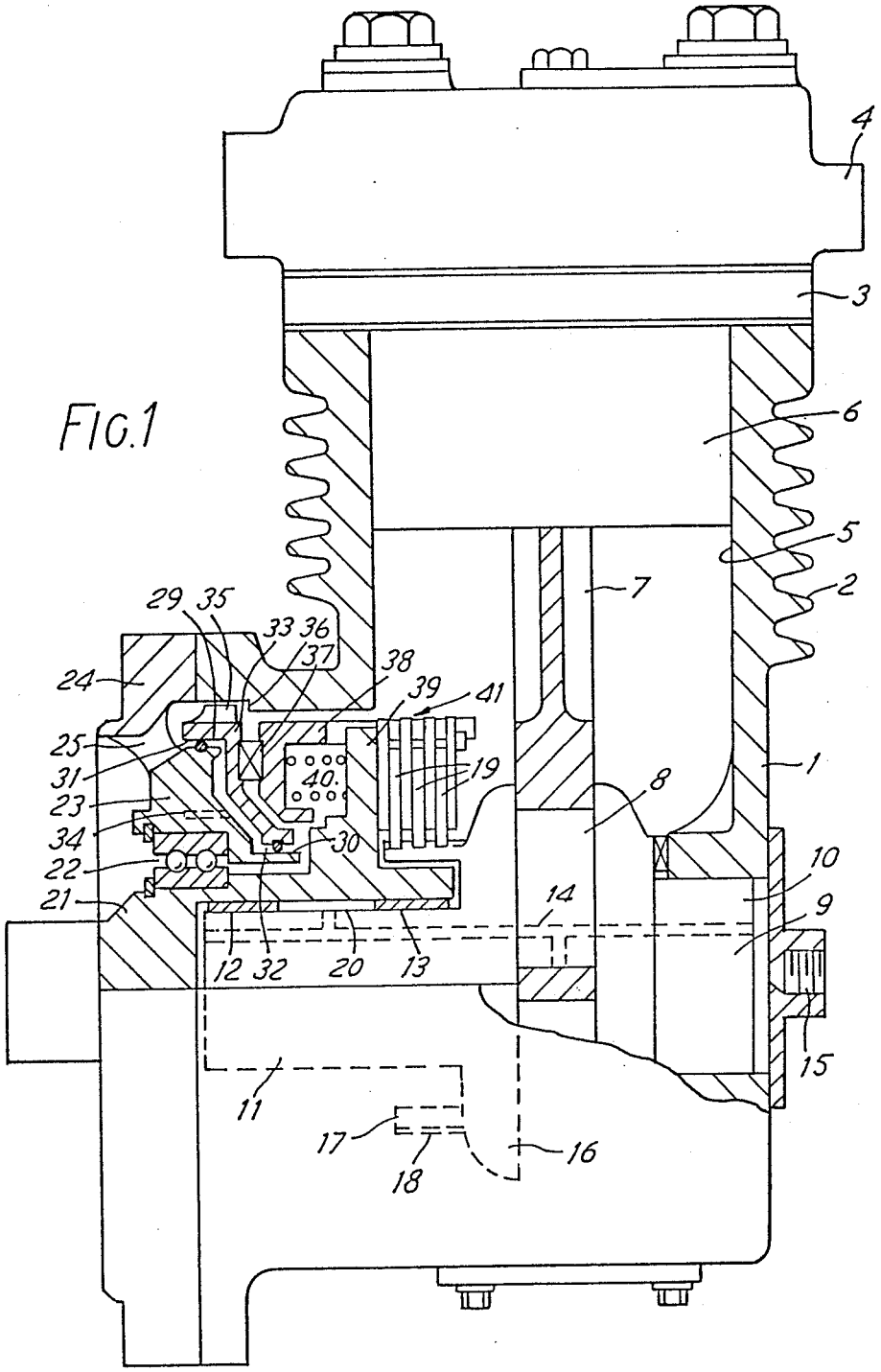

4
3
6
5
2
7
1
8
10
9
15
14
29
35
33
36
37
38
39
41
24
25
31
23
34
22
21
40
19
30
12
32
20
13
11
17
18
16

CLUTCH DRIVEN COMPRESSOR ASSEMBLY

This invention relates to a clutch driven compressor assembly and relates more especially to a piston and cylinder compressor assembly having a crankshaft driven by an input shaft via a releasable clutch.

Reciprocating piston air compressors have already been proposed wherein a crankshaft is driven by an input shaft via a clutch. Typically, such a compressor is driven via a gear train by an engine of a heavy road vehicle, for charging several compressed air reservoirs for the braking and other compressed air systems of the vehicle. By pneumatic operation of a clutch release mechanism, the drive from the input shaft to the compressor crankshaft can readily be interrupted when the reservoirs are fully charged and for many applications this is considered to be technically preferable to rather more conventional system whereby a continuously running compressor is unloaded by means of an unloader valve. When a releaseable clutch is employed the compressor stops rotating upon unloading whereas with an unloader valve the compressor runs continuously absorbing some power and increasing wear.

One disadvantage of a clutch-driven air compressor as proposed hitherto has been that it tends to be somewhat bulky owing to the substantial space requirement imposed by the physical size of the clutch.

In published U.K. Patent Specification No. 2,176,255, there is described and illustrated a clutch driven compressor assembly which comprises a housing with a rotatable input shaft releaseably coupled via a multiplate friction clutch to the crankshaft of the compressor. The compressor is conventional in so far as a crankpin of the crankshaft is coupled by a connecting rod to a piston which is thereby reciprocable in a cylinder. However, a particular feature of the assembly is that the clutch is at least partially accommodated in space defined by a projection of the cylinder. By virtue of such an arrangement an axially shorter and more compact assembly may be realized than is possible with more conventional arrangements. Nevertheless, certain shortcomings exist with an arrangement as described in said published specification. One shortcoming is that the stroke of the crank in one embodiment is limited, whereas in another arrangement, there may be operating alignment problems with the bearings. A further shortcoming common to both may also reside in that a convenient path for draining away surplus oil from pressure lubricated bearings is difficult to provide for.

The present invention seeks to provide an improved clutch-driven compressor assembly whereby the above shortcomings may be removed or at least substantially reduced.

According to the present invention there is provided a clutch-driven piston and cylinder compressor assembly comprising a compressor housing having an input member rotatable in bearing means of the housing and a compressor crankshaft provided with further bearing means for rotation concentrically with said input shaft and a drive clutch contained at least partially in a space of the housing defined by a projection of the cylinder 5, said clutch being selectively operable to provide rotational engagement between the input shaft and the compressor shaft, characterised by the input shaft having a drive member axially slideably engageable with a shell of the clutch and resilient means acting between the shell and said drive member to urge driving and driven clutch plates into mutual engagement and a fluid pressure operable release member for the clutch acting between the housing and the shell and being carried on an island portion of the housing concentric with said bearings.

Preferably, the crankshaft of the air compressor has an axial extension rotatably carried in bearings of the input member the extension being of such length as to support the crankshaft in the input member and the first mentioned bearing means.

By virtue of the release member being carried on an island portion of the housing free flow of air and lubricant can take place around it.

Figure 2:
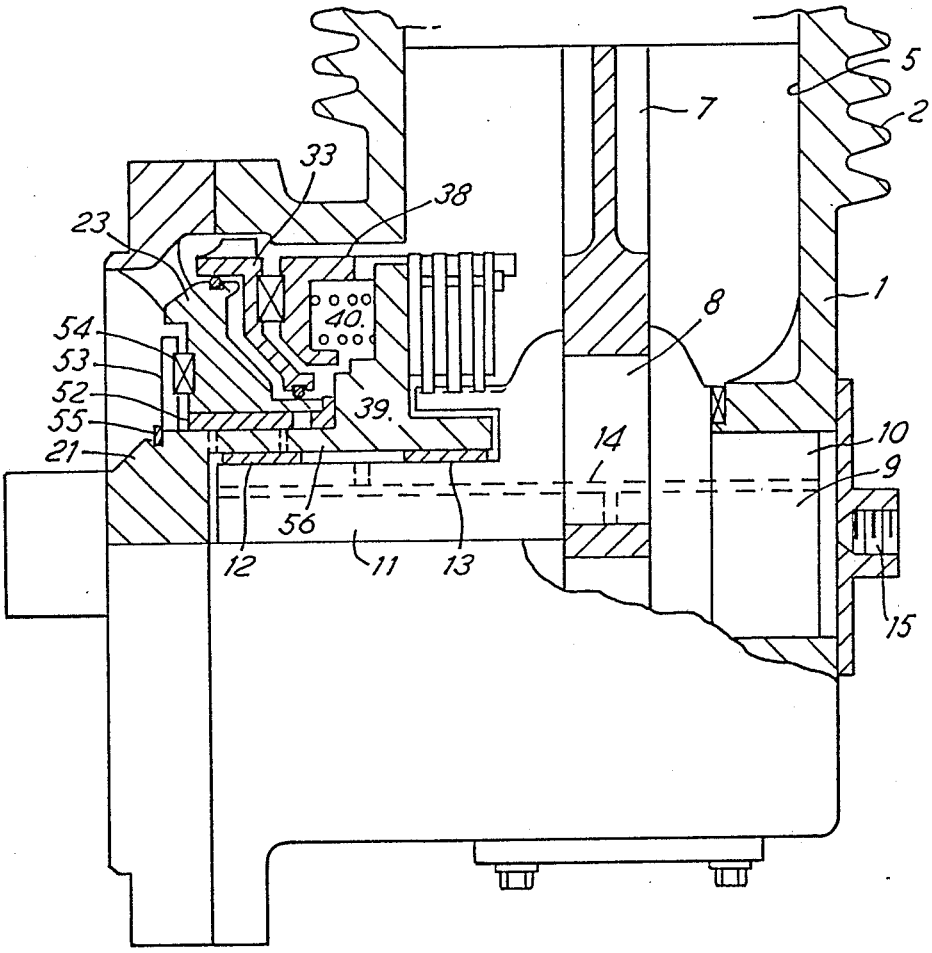
Figure 3:
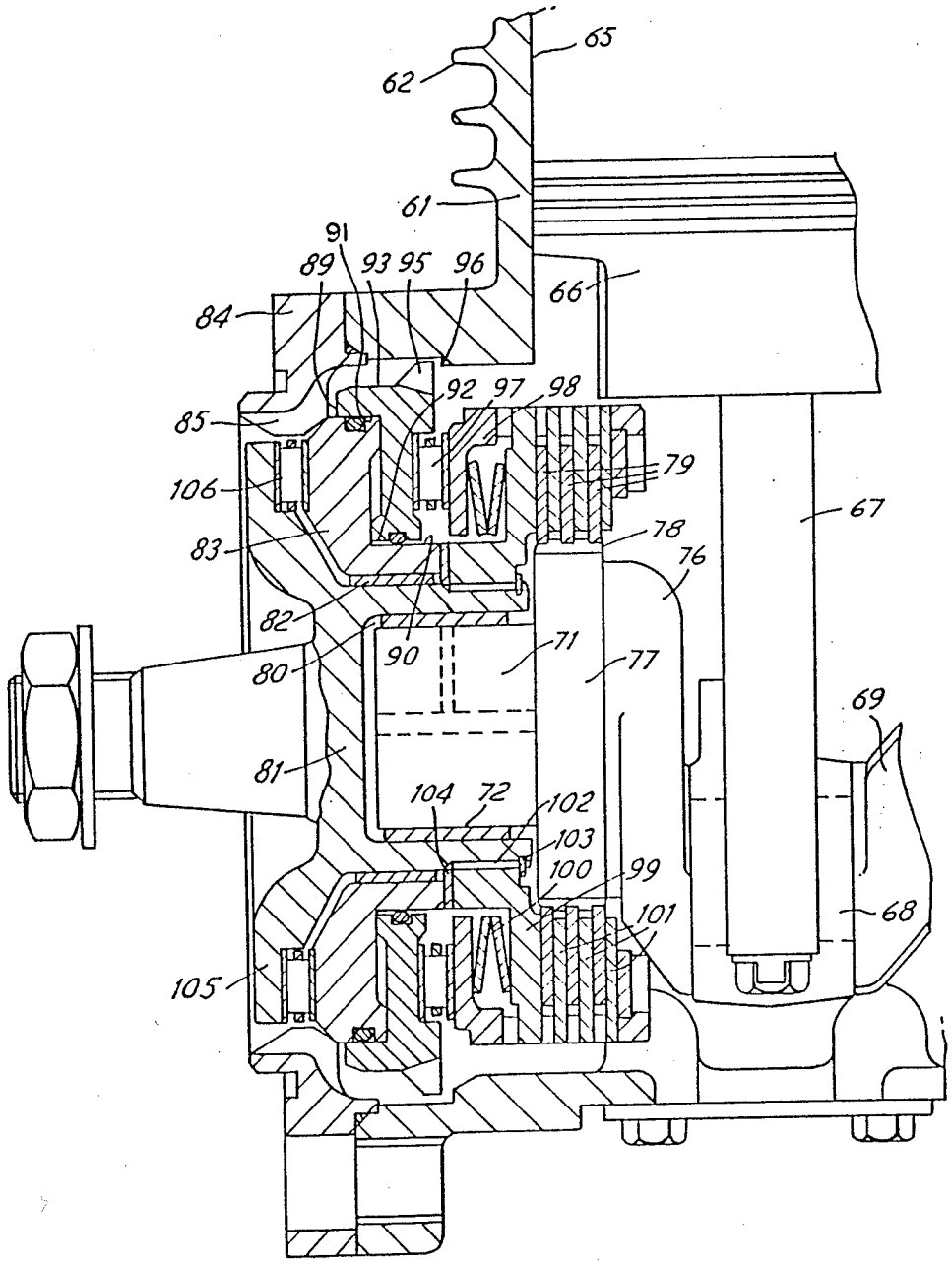

In order that the invention may be more clearly understood and readily carried into effect, the same will be further described by way of example with reference to the accompanying drawings of which FIGS. 1, 2 and 3 of which illustrate alternative embodiments of a single cylinder air compressor incorporating a mechanism in accordance with the invention.

Referring to FIG. 1 of the drawings, a compressor assembly has a housing comprising a crankcase and cylinder 1 with cooling fins 2 around the cylinder portion and the cylinder portion being provided with a valve plate 3 and a cylinder head 4. A piston 6 is reciprocable in a bore 5 within the housing via a connecting rod 7 actuable by a crankpin 8 of a crankshaft 9. The free end of the crankshaft 9 is carried in a pressure-lubricated bearing 10 in one end of the crankcase and the driven end of the crankshaft takes the form of an axial extension 11, carried in plain bearings 12 and 13 pressure lubricated, together with the crankpin 8, from a pressure feed passage 14 supplied with oil under pressure from a port 15.

The crankshaft is somewhat unconventional for a compressor to the extent that the drive-side crankweb is circular, as indicated by the broken outline 16 and carries a short axial annular projection 17 having external splines 18 for engagement with driven friction plates 19 of a friction clutch now to be described further below.

The plain bearings 12 and 13 mentioned above are located in an axial recess 20 of a rotatable input member 21 which runs in a roller bearing 22 captive in an annular central island portion 23 of an end plate 24 of the housing. The central portion 23 is joined to the surrounding part of the end plate 24 via webs 25 which thereby allow unrestricted communication between the crankcase of the compressor and the crankcase of an engine to which it is mounted.

The central portion has two machined cylindrical surfaces 29 and 30 relative to which complimentary surfaces of a pressure responsive member 33, namely surfaces 31 and 32 are sealingly slideable. A control port (not shown) for applying a pressure signal to the pressure responsive member 33 is connected via a passage shown dotted at 34 and the member 33 is provided with three or more peripheral projections 35 engageable with an annular abutment 36 provided in the housing. The pressure responsive member 33 is further engageable, via the roller thrust race 37, with the left-hand side of a shell 38 of the clutch, between which an annular flange 39 of the rotatable input member 21, there is a series of springs such as 40 located in recesses equally spaced around the axis. These springs 40 act in a sense to maintain the clutch plates in mutual engagement and rotation of the input member 21 by a gear train (not shown) is transmitted to the clutch shell 38 radial projection of the flange 39 which together with clutch drive plates 41 locate in axial cuts in the skirt of shell 38.

In operation input shaft rotation is transmitted by the drive plates 41 and driven plates 19, to splines 18 of the projection 17. The compressor therefore operates to supply compressed air to reservoirs until a certain pressure is reached at which point a pressure signal is applied to passage 34. Such pressure signal acts between the central island portion 23 of plate 24 and the pressure responsive member 33 to urge the shell 38 against the action of the springs 40, releasing the force being reacted axially by bearing 22. The clutch plates 41 and 19 are thereby mutually freed so that whilst the shell 38 continues to rotate, the crankshaft 9 becomes stationary. Release of the pressure signal in passage 34 occurs when the reservoir pressure has fallen to a set lower value and this immediately causes re-engagement of the clutch to resume the drive to the crankshaft.

By virtue of the extensions 35, referred to above, on the periphery of the pressure responsive member 33 coming into abutment with 36, the bearing 22 is relieved of any excessive forces which might be applied by virtue of greater-than-normal signal pressure in passage 34 acting on pressure responsive member 33.

By virtue of the pressure responsive member 33 being sealingly engageable with central island portion of the housing, a virtual unimpeded way through for breathing between the engine and the crankcase of the compressor can be provided as mentioned above. Furthermore, by virtue of the extension 11 of the crankshaft, through bearings 12 and 13, being such as to transfer forces on the crankshaft to bearing 22, this bearing functions in normal operation as a main bearing for the compressor. Plain bearings 12 and 13 are only subjected to rotation during off-load periods when the clutch is disengaged. When the clutch is released by a pressure signal in passage 34 acting on member 33, the force of springs 40 is transferred from the clutch plates 19, 41 to the island portion 23 via flange 39 and bearing 22. In addition to functioning as a main bearing the bearing 22 therefore has to be sufficiently robust to withstand such axial forces across it for the off-load periods of the compressor.

In order to avoid the need for one main bearing such as 22 of the assembly of FIG. 1 to withstand such substantial axial operating forces an alternative arrangement may be adopted is illustrated in FIG. 2.

Referring to FIG. 2, it will be seen that this assembly is generally the same as that described above with reference to FIG. 1 but the main bearing 22 has been replaced by a plain bearing 52. Although 52 may be incapable of withstanding or supporting any axial forces the central island portion 23 which carries bearing 52 is further recessed to accomodate a thrust plate 53 retained on the input shaft by a circlip 55. A further roller bearing thrust race 54 is also now provided between thrust plate 53 and the central island protion. Yet another small annular thrust member or wear piece of suitable material, denoted by reference 56, is provided on the input member 21 adjacent to the flange and occupying a space between the island portion 23 and flange. The bearings and thrust races are again fed by oil via passageways as indicated in broken lines leading from the passageway 14 which is supplied with lubricant under pressure as before.

During normal operation no pressure signal is fed to the space between pressure responsive member 33 and the island portion 23. The clutch plates are, therefore, urged together as before by springs 40. The input member 21 running in plain bearing drives the crankshaft 9 through flange 39 and the clutch plates There is normally no relative rotation between the extension 11 of the crankshaft and the input member via bearings and since the force of springs 40 is contained within the clutch negligible axial forces are experienced by the thrust plate 53 and thrust bearing 54. However, when a pressure signal is applied to the pressure responsive member 33 the force resulting therefrom is applied to shell 38 to release the force of springs 40 from the clutch plates. Such force of springs 40 is then transferred as before via circlip 55, thrust plate 53 and thrust race 54 to the central island portion of the compressor housing.

Referring now to FIG. 3 of the drawing, in this preferred embodiment the compressor assembly has a housing comprising a crankcase and cylinder 61 fragmentally shown on a larger scale with cooling fins 62 around the cylinder portion and the cylinder portion being again provided with a conventional valve plate and cylinder head (not shown). A piston 66 is reciprocable in a bore 65 within the housing via a connecting rod 67 actuable by a crankpin 68 of the crankshaft 69. The free end of the crankshaft (not shown) is carried in a pressure lubricated bearing (not shown) in one end of the crankcase and the driven end of the crankcase takes the form of an axial extension 71, carried in a pressure lubricated plain bearing 72 supplied with oil together with the crankpin 68, from a pressure feed passage 74 from the engine lubrication system. The driveside crankweb 76 carries a short axial annular projection 77 having splines 78 for engagement with driven friction plates 79 of friction clutch.

The plain bearing 72 mentioned above is located in an axial recess 80 of a rotatable input member 81 which runs in a plane bearing 82, captive in a central island portion 83 of the end plate 84 of the housing. As in FIGS. 1 and 2 the island portion 83 of FIG. 3 is joined to the surrounding part of the end plate 84 via webs 85 which thereby provide unrestricted communication between the crankcase of the compressor and the crankcase of an engine to which it is mounted.

The island portion has two machined cylindrical surfaces 89 and 90 relative to which complimentary surfaces 91 and 92 of a pressure responsive member 93, are sealingly slideable. A control port (not shown) for applying a pressure signal to the pressure responsive member 93 is connected via a passage (not shown). The member 93 is also provided with three or more peripheral projections 95 engageable with an abutment 96 provided in the housing.

Member 93 is further engageable, via the roller thrust race 97 with the left hand side of a shell 98 of the clutch. Between the shell 98 and an annular flange 99 carried on splines on rotatable input member 81, there are disc springs 100 located in an annular space around the axis of the input member. Springs 100 act in a sense to maintain the clutch plates in mutual engagement and rotation of the input member 81 by a gear train (not shown) is transmitted to the clutch shell 98 via flange 99 The annular flange 99 is retained in axial position on splines 102 by a substantial circlip 103 and located between the circlip 103 and the island portion 83 by a thrust washer 104. Further, the input member 81 has a radially-outward extending outer flange portion 105 between which and island portion 83 there is a large diameter thrust race 106. The thrust race 106 and the thrust washer 104 act to maintain the recess 80 axially positioned in the crankcase against the action of the spring 100 whilst keeping 71 in line with plain bearing 72.

In operation, rotation of member 81 is transmitted via drive plates 101 and driven plates 79 to splines 8 of the projection 77. The compressor therefore operates to supply compressed air to reservoirs until a certain pressure is reached at which a pressure signal is applied to the annular region between surfaces 89 and 90 to act between the portion 83 and the pressure responsive member 93 and urges the shell 98 against the action of the springs 100. The clutch releasing force is reacted axially by bearing 106 and the clutch plates 101 and 79 are thereby mutually freed so that whilst the shell 98 continues to rotate, the crankshaft 69 becomes stationary. Release of the pressure signal immediately causes re-engagment of the clutch to resume the drive to the crankshaft.

It will be appreciated that whilst the operation of the preferred compressor assembly of FIG. 3 is essentially the same as that of FIGS. 1 and 2, by providing the member 80 with a substantial annular flange 105 and introducing a thrust bearing 106 the bearing 82 does not require to be of excessive length in order to maintain the crankshaft bearing 72 in working alignment.

It will be seen from the foregoing that by virtue of the invention a relatively compact and robust clutch-driven compressor assembly is made possible. Furthermore, although several particular embodiments have been described in the foregoing, the invention is by no means limited to such particular embodiments. Moreover, the invention is equally applicable to compressors having more than one cylinder.

I claim:

1. A clutch driven compressor assembly comprising a housing defining a cylinder therewithin, a piston slidably mounted in said cylinder for reciprocation therewith, a crankshaft member, means rotatably supporting said crankshaft member in said housing, means for drivably engaging the piston with the crankshaft member for rotating the latter upon reciprocation of the piston, said rotatably supporting means including an input member, first bearing means supporting said input member in said housing, and second bearing means rotatably supporting said crankshaft member relative to said input member, clutch means for providing selective driving engagement between said input member and said crankshaft member, said housing including openings circumscribing said first bearing means and cooperating with the latter to define an island portion of the housing, said clutch means including driving and driven clutch plates plates on said members, an annular clutch shell within said housing and rotatable with one of said members, said shell being shiftable between clutch engaged and clutch disengaged positions, spring means acting on said shell yieldable urging the latter to a clutch engaged position, and a release member slidably mounted on said island portion and cooperating with the latter to define a pressure chamber therebetween, means connecting said release member with said shell for shifting the latter between said clutch engaged and disengaged positions in response to movement of said release member, and means for selectively communicating fluid pressure into said pressure chamber, said release member and said clutch shell cooperating with said housing to define a passage communicating said cylinder with said openings.

2. Clutch driven compressor as claimed in claim 1, wherein said input member includes a driven member slidably supporting said clutch shell.

3. Clutch driven compressor as claimed in claim 2, wherein said driven member is a flange projecting radially from said input member.

4. Clutch driven compressor as claimed in claim 3, wherein said release member is an annular piston defining an outer circumferential surface, said outer surface cooperating with said housing to define a corresponding portion of said passage means.

5. Clutch driven compressor as claimed in claim 4, wherein said release member includes a pair of radially spaced sliding surfaces, said sliding surfaces slidably engaging a corresponding pair of sliding surfaces on said island member.

6. Clutch driven compressor as claimed in claim 5, wherein said annular piston includes stop means on said outer circumferential surface, said stop means engaging a corresponding stop surface on said housing to limit the range of sliding movement of said annular piston.

* * * * *